US005768973A

United States Patent [19]

Cochran

[11] Patent Number: 5,768,973

[45] Date of Patent: Jun. 23, 1998

[54] HYDRAULIC LINE AND VALVE ASSEMBLY FOR CONSTRUCTION VEHICLE AUXILIARY IMPLEMENTS

[76] Inventor: Gary Cochran, 3052 N. Forrest Lakes, Wichita, Kans. 67205

[21] Appl. No.: 773,607

[22] Filed: Dec. 27, 1996

[51] Int. Cl.[6] ..... F15B 11/00

[52] U.S. Cl. ..... 91/516; 91/532

[58] Field of Search ..... 91/516, 532, 508, 91/511, 514, 427; 60/426

[56] References Cited

U.S. PATENT DOCUMENTS

| | | | |
|---|---|---|---|
| 3,994,133 | 11/1976 | Pfeil et al. | 91/516 X |
| 4,005,636 | 2/1977 | Dunn | 91/516 X |
| 4,430,926 | 2/1984 | Wallace | 91/516 |
| 4,966,066 | 10/1990 | Kauss et al. | 91/516 |
| 5,060,556 | 10/1991 | Weirich et al. | 91/427 X |
| 5,072,802 | 12/1991 | Tischer | 91/516 X |
| 5,471,908 | 12/1995 | Lech | 91/516 |

*Primary Examiner*—Hoang Nguyen
*Attorney, Agent, or Firm*—Kenneth H. Jack

[57] ABSTRACT

An hydraulic line and valve assembly for supplying hydraulic pressure to an hydraulic auxiliary implement, the implement being adapted for attachment to a construction vehicle having an hydraulic power system, the implement having an hydraulic motor driven workpiece, and the implement having a plurality of hydraulic positioning means; the hydraulic line and valve assembly comprising an on demand priority flow control valve, a branched primary pressure line an end of which being fixedly attached to the on demand priority flow control valve, a plurality of position control valves, the position control valves being fixedly attached to the opposing branched ends of the primary pressure line, and a branched hydraulic load signaling line extending from the position control valves to the on demand priority flow control valve, the hydraulic load signaling line being capable of sending pressure signals to the on demand priority flow control valve causing said valve to divert hydraulic pressure to the position control valves.

8 Claims, 3 Drawing Sheets

HYDRAULIC LINE AND VALVE ASSEMBLY FOR CONSTRUCTION VEHICLE AUXILIARY IMPLEMENTS

FIELD OF THE INVENTION

This invention relates to a hydraulic line and valve assembly for supplying hydraulic power to auxiliary implements attachable to construction vehicles such as a front loader tractor, a backhoe—front loader, or a skid steer loader.

BACKGROUND OF THE INVENTION

The present inventive hydraulic line and valve assembly is applicable in general to self-propelled construction vehicles having hydraulic power systems. A typical example is a front loader construction vehicle having a pair of lift arms pivotally mounted on opposing sides of the vehicle; the lift arms extending forward beyond the front end of the vehicle. A loader bucket is pivotally mounted upon the front ends of the lift arms, spanning between and interconnecting the lift arms. The vehicle typically has a hydraulic power system; the driving force providing pivotal motion of the lift arms about their pivot points being provided by a pair of double acting hydraulic cylinders. Pivotal motion of the loader bucket about its pivot points is provided by a second pair of double acting hydraulic cylinders. Typically, a loader valve actuatable from the cab or operator's seat of the vehicle provides selective control of the lift arm and the loader bucket hydraulic cylinders, allowing the loader bucket to be selectively raised or lowered, and allowing the angular orientation of the loader bucket to be controlled for scooping, raising and lowering, and dumping operations.

The loader valve of a front loader construction vehicle, as described above, typically has a power forward pressure port allowing an additional hydraulic pressure line to provide power to an auxiliary hydraulically driven implement attachable to the loader bucket. An example of such an auxiliary implement is a hydraulic grapple. Such an auxiliary implement is typically controlled by an auxiliary hydraulic valve mounted upon the vehicle and positioned in line between the loader valve and the implement.

It has become common practice to attach more complex hydraulically driven machinery to the lift arms of a front loader construction vehicle. For example, the loader bucket of skid steer loader may be removed and a cold planing machine for grinding and removing layers of asphalt and concrete surfaces may be attached in its place. Upon such attachment, the lift arm hydraulic cylinders operate to vertically raise and lower the cold planer, and the loader bucket hydraulic cylinders operate to control the angular orientation of the cold planer.

Such a cold planer typically has a grinding drum which is rotatably driven by a hydraulic motor. Lateral positioning of the grinding drum is typically controlled by a double acting hydraulic cylinder, or by hydraulic motor driven positioning gears. Vertical positioning and tilt of the grinding drum may similarly be controlled by double acting hydraulic cylinders, or hydraulic motor driven gears. Commonly, the power forward hydraulic pressure line extending from the loader valve of a skid steer loader will provide insufficient hydraulic oil flow to drive the additional hydraulic motors hydraulic cylinders required to operate a cold planer.

In order to supply the additional hydraulic oil flow needed when an auxiliary implement such as a cold planer is attached in place of the loader bucket of a front loader construction vehicle, an auxiliary high flow hydraulic pump is commonly installed as part of the vehicle's hydraulic power system along with an auxiliary network of hydraulic lines and valves, allowing hydraulic oil flowing from the auxiliary pump to cumulatively combine with oil from the loader valve power forward pressure line.

The instant invention provides a novel, inventive, and unique configuration of hydraulic lines and valves for providing hydraulic power to such a front loader auxiliary implement.

DESCRIPTION OF THE PRIOR ART

The hydraulic schematic diagram appearing as FIG. 1 of the appended drawings hereto portrays a known hydraulic line and valve configuration for an exemplary attachment of an auxiliary hydraulically driven cold planing machine to the lift arms of a front loader construction vehicle such as a skid steer loader having a hydraulic power system. Referring to FIG. 1, a main hydraulic pump 1 and an auxiliary high flow hydraulic pump 3, each supplying approximately 17 gallons per minute of flow, draw hydraulic oil from a hydraulic oil reservoir 5. A main pump pressure line 7 extends from the high pressure output port of the main hydraulic pump 1, and is controlled by a pair of five port three position loader bucket valves 9 and 11; valve 9 controlling the lift arm cylinders, and valve 11 controlling the loader bucket cylinders. When the loader bucket valves 9 and 11 are in their normal positions, pressure from the main pump pressure line 7 passes through unrestricted to a loader bucket valve power forward line 13. Upon actuation of either loader bucket valve 9 or 11, hydraulic pressure is selectively diverted from the loader bucket valve power forward line 13 to the lift arm cylinder lines 15 and 17 or the loader bucket cylinder lines 19 and 21, with return oil flow passing through a lift arm return line 23 or through a loader bucket return line 25.

Pressure from the loader bucket valve power forward line 13 is controlled by a vehicle mounted five port, two position auxiliary hydraulic valve 27. When the auxiliary hydraulic valve 27 is in its normal position, pressure from the loader bucket valve power forward line 13 passes through unrestricted to an auxiliary valve power forward line 29. Upon actuation of the auxiliary hydraulic valve 27, pressure from the loader bucket valve power forward line 13 is diverted from the auxiliary power forward line 29 to cold planer cylinder pressure lines 31 and 33 and thence through an auxiliary valve return line 35 for return to the reservoir 5.

When the main hydraulic pump 1 and the auxiliary high flow hydraulic pump 3 are activated and when valves 9, 11, and 27 are in their normal positions, pressure from the auxiliary power forward line 29 and from the high flow pump pressure line 37 cumulatively merge to supply a high flow line 39, with approximately 34 gallons per minute of flow. Pressure from the high flow line 39 is controlled by a two position vehicle mounted high flow valve 41 which in its normal position returns flow from the high flow line 39 to the reservoir 5 through a high flow valve return line 47. Upon actuation of the high flow valve 41, pressure from the high flow line 39 passes through to a planer motor pressure line 69 supplying sufficient hydraulic pressure and flow to drive a hydraulic planer motor 43, with hydraulic oil returning through a planer motor return line 45, and thence through the high flow valve return line 47 to return to the hydraulic oil reservoir 5.

While the loader bucket valves 9 and 11 are in their normal positions, and upon actuation of the auxiliary hydraulic valve 27 to divert hydraulic oil flow from the auxiliary power forward line 29 to the cold planer cylinder pressure lines 31 and 33, hydraulic pressure may be selectively supplied to a double acting cold planer side shift cylinder 49, a double acting cold planer tilt control cylinder 51, or to a double acting cold planer depth control cylinder 53. Alternately, positioning cylinders 49, 51, and 53 may be replaced by hydraulic motor driven positioning gears. Oil pressure and flow to the cold planer positioning cylinders is controlled by the combined action of the auxiliary hydraulic valve 27 and a side shift valve 55, a tilt control valve 57 and a depth control valve 59, each being a two position, four port valve. The side shift, tilt control, and depth control valves 55, 57, and 59 operate to selectively supply pressure and flow to any of the three cold planer cylinders while the auxiliary hydraulic valve 27 selectively provides bi-directional extension and retraction pressure to the powered cylinders.

A problem or deficiency created by the known hydraulic line and valve assembly represented in FIG. 1 is that during operation of the cold planer, hydraulic oil flow and pressure from the main hydraulic pump 1 and the auxiliary high flow hydraulic pump 3 is supplied to the hydraulic planer motor 43 with no priority flow being provided to control the side shift, tilt control, and depth control cylinders 49, 51 and 53. For purposes of safety and ease of operation, it is preferable to assure a continuous power supply to the side shift, tilt control, and depth control cylinders 49, 51 and 63, with a secondary power supply being provided to the hydraulic planer motor 43. A further problem or deficiency created by the hydraulic line and valve assembly portrayed in FIG. 1 rests in the fact that it requires four flow checked hydraulic line couplings 61, 63, 65, and 67 for attaching the hydraulic control lines of the cold planer to the hydraulic system of the skid steer loader. The requirement of four hydraulic line attachments increases the potential for introduction of dirt into the hydraulic system. Also, requiring four connections increases the time and difficulty of attachment. Also, requiring four connections increases the potential for erroneous misconnection of hydraulic lines. Additionally, a requirement of four connections increases the likelihood that the couplings of a particular auxiliary implement will not fit the auxiliary line couplings of a particular front loader construction vehicle.

Accordingly, it is an object of the present invention to provide a hydraulic line and valve assembly for hydraulically connecting auxiliary hydraulic motor and cylinder driven implements to the hydraulic system of a construction vehicle having a hydraulic power system, while providing priority hydraulic power to the positioning cylinders or hydraulic motors of such auxiliary hydraulic implement, and providing secondary power to a hydraulic motor of such auxiliary hydraulic implement.

It is a further object of the present invention to provide a hydraulic line and valve assembly for hydraulically connecting such an auxiliary hydraulic implement to the hydraulic system of a construction vehicle, such assembly requiring a reduced number of hydraulic line couplings between the auxiliary hydraulic implement and the hydraulic system of the construction vehicle.

Other and further objects and benefits of the present invention will become apparent upon review of the detailed description appended drawings which follow.

DETAILED DESCRIPTION

Figure 1:
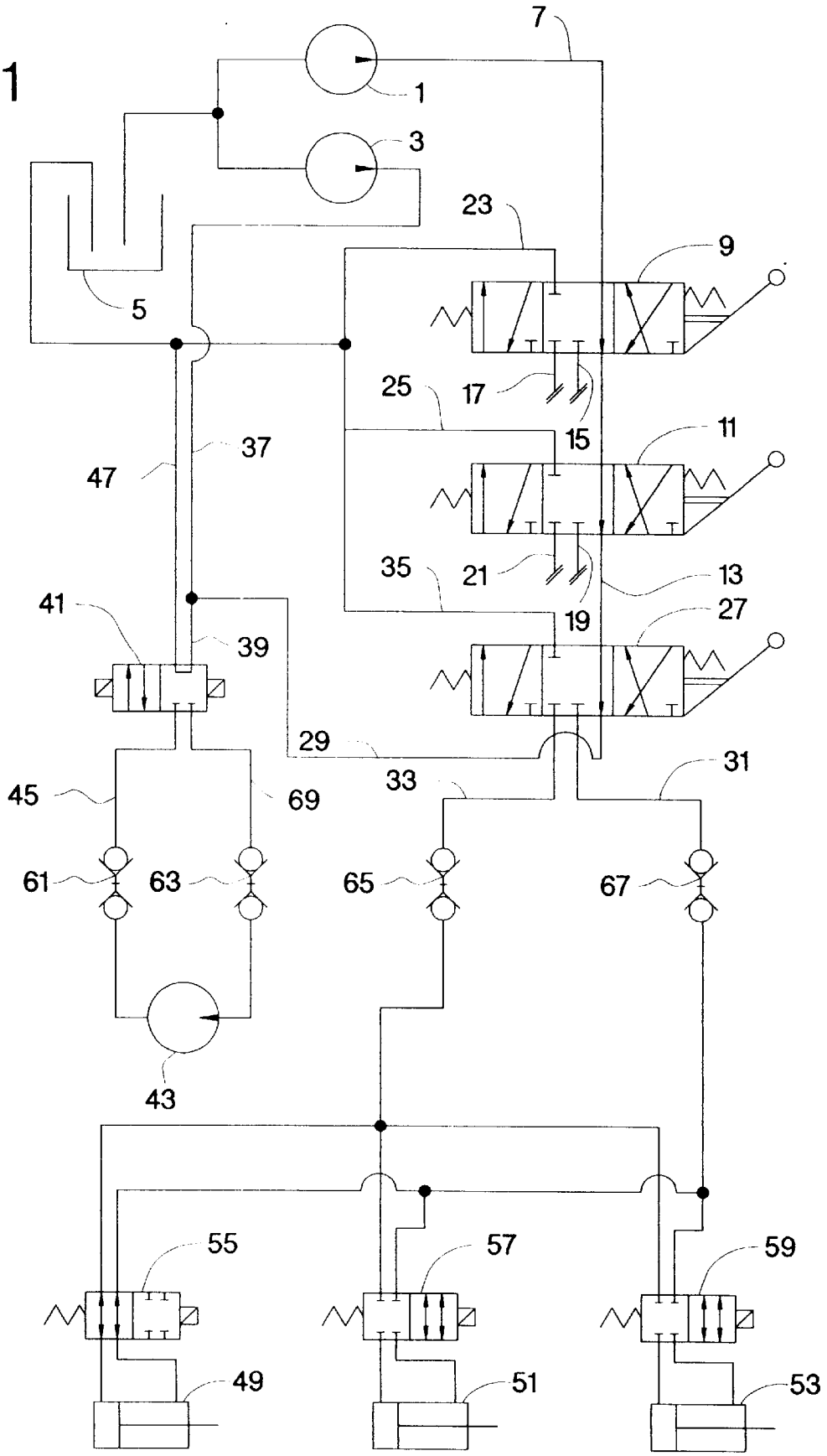
FIG. 1 is the hydraulic schematic as discussed above.
Figure 2:
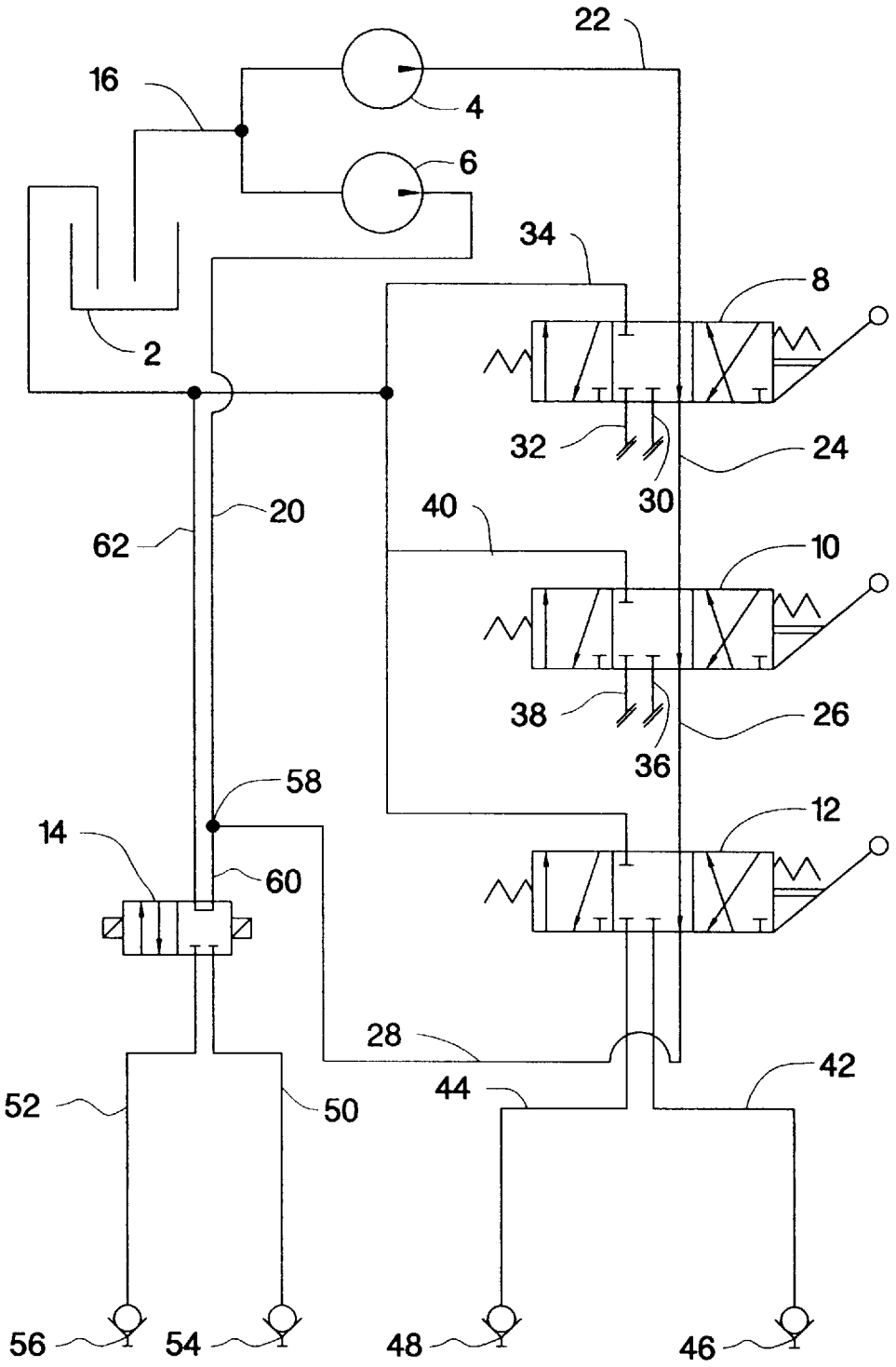
FIG. 2 is a hydraulic schematic portraying the hydraulic system of an exemplary typical front loader construction vehicle such as a skid steer loader, having installed thereon an auxiliary high flow pump and attendant connecting lines and valves.

FIG. 2 of the drawings appended hereto is a schematic diagram of a hydraulic power system of a front loader construction vehicle such as a front loader tractor or a skid steer loader; such hydraulic power system being adapted for operation of auxiliary hydraulic implements attachable and operable from the lift arms of the front loader construction vehicle.

The hydraulic oil reservoir 2, the main hydraulic pump 4, the auxiliary high flow hydraulic pump 6, the lift arm control valve 8, the loader bucket control valve 10, the auxiliary hydraulic valve 12, and the high flow valve 14 all are typically mounted upon and operable from the front loader construction vehicle.

When the hydraulic power system depicted at FIG. 2 is used for operation of the front loader construction vehicle's lift arms and loader bucket, without operation of any auxiliary implement, the main hydraulic pump 4 draws hydraulic oil from the hydraulic oil reservoir 2 through a reservoir output line 16.

The lift arm valve 8, the loader bucket valve 10, and the auxiliary hydraulic valve 12 are each five port, three position cylinder control valves, the fifth port of each such valve being a power forward port. While each of the valves 8, 10, and 12 are in their normal positions, their power forward ports are open and their cylinder control ports are closed, allowing oil from the main pump pressure line 22 to pass from the main hydraulic pump 4 through the lift arm valve 8. Pressurized oil from the main pump pressure line 22 then emits from the power forward port of the lift arm valve 8 into a lift arm power forward line 24 to enter the loader bucket valve 10. Oil from the lift arm power forward line 24 then emits from the power forward port of the loader bucket valve 10 to pass through the loader bucket power forward line 26. Oil from the loader bucket power forward line 26 then enters the auxiliary hydraulic valve 12 to emit from the auxiliary power forward line 28. Oil from the auxiliary power forward line 28 combines with oil from the high flow hydraulic pump 6 passing through a high flow pump pressure line 20 to cumulatively join at a double flow juncture 58. While the high flow valve 14 is in its normal position, and while valves 12, 10 and 8 are in their normal positions oil passes from the double flow juncture 58 through a double flow line 60 to pass without restriction through the high flow valve 14 to return to the reservoir 2 through a high flow valve return line 62.

Upon actuation of the lift arm valve 8, hydraulic pressure and flow is diverted from the lift arm valve power forward line 24 to the lift arm cylinder lines 30 and 32 to return to the reservoir 2 through a lift arm valve return line 34. The lift arm valve 8 may be selectively actuated for bi-directional control, causing the lift arm cylinders to either extend or retract.

Alternately, the loader bucket valve 10 may be actuated to divert hydraulic pressure and flow from the loader bucket valve power forward line 26 to the loader bucket cylinder lines 36 and 38 to return to the reservoir 2 through a loader bucket valve return line 40. The loader bucket valve 10 may similarly be selectively actuated for bi-directional control, extending or retracting the loader bucket cylinders.

The auxiliary hydraulic valve 12 typically has a pair of bi-directional pressure ports and auxiliary pressure lines 42 and 44 attached thereto, the auxiliary pressure lines being capped by flow checked line couplings 46 and 48. In the hydraulic line and valve assembly of the present invention, couplings 46 and 48 serve as end plugs for auxiliary pressure lines 44 and 42, with no hydraulic lines or implements being attached thereto.

The high flow valve 14 similarly has a pair of high flow pressures lines 50 and 52, the high flow pressure lines being capped by flow checked couplings 54 and 56. Upon actuation of the high flow pump 6 and the main pump 4, and upon valves 8, 10 and 12 remaining in their normal positions, approximately seventeen gallons per minute of hydraulic oil flow will pass through the auxiliary hydraulic valve power forward line 28, and an additional seventeen gallons per minute of flow will pass through the high flow pump pressure line 20 to join at the double flow juncture 58, providing approximately 34 gallons per minute of flow through the double flow line 60. While valves 8, 10 and 12 are so positioned and upon actuation of the main pump 4 and the high flow pump 6, the high flow valve 14 may be actuated causing the high flow valve pressure line 50 to supply approximately 34 gallons per minute of flow to an auxiliary implement, and allowing high flow valve line 52 to serve as a return line, allowing oil to return to the reservoir 2 through a high flow return line 62.

Figure 3:
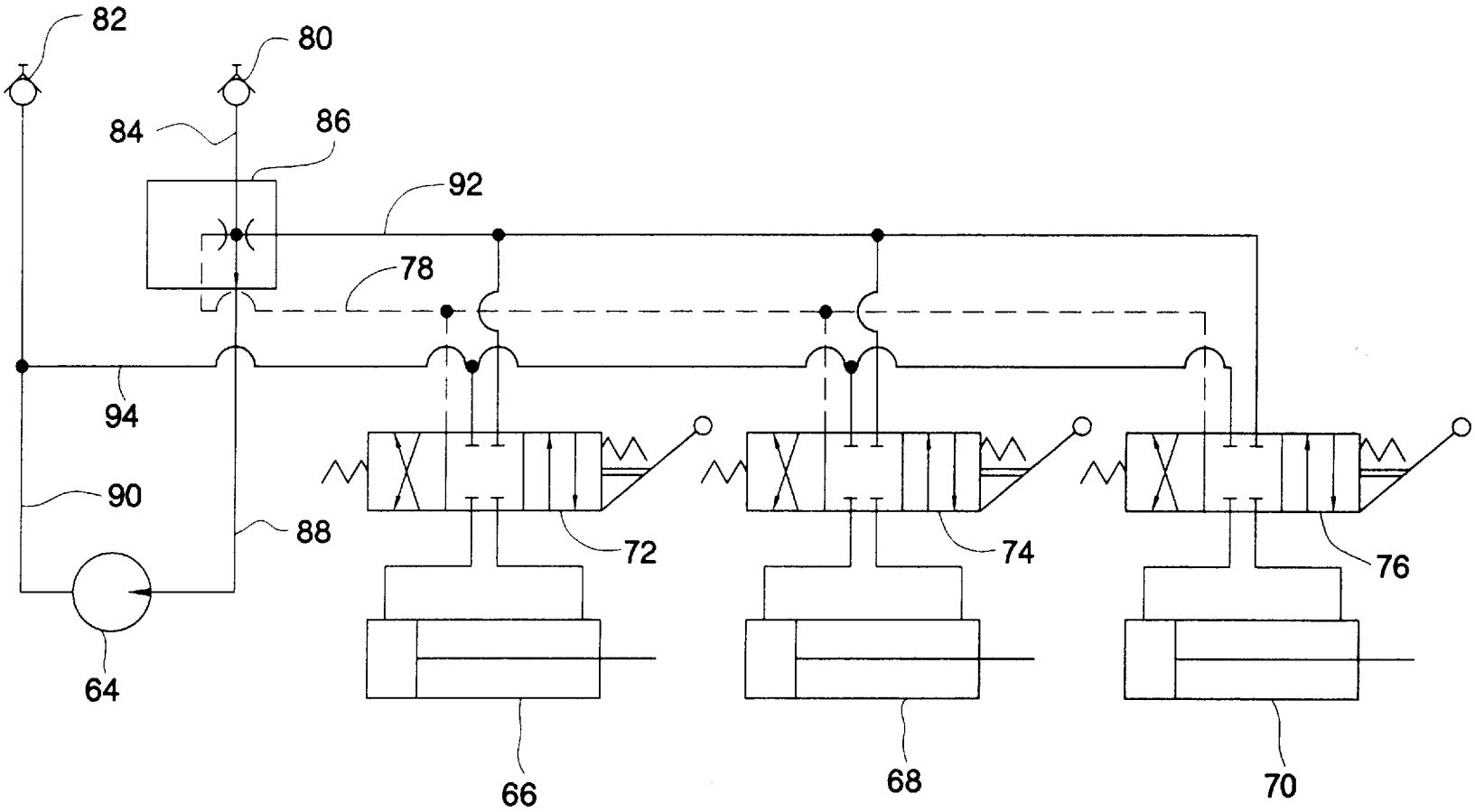
FIG. 3 is an exemplary hydraulic schematic of configuration of the present invention portraying the hydraulic lines, valves, motor, and cylinders of an auxiliary hydraulic implement such as a cold planer attachable to the lift arms of a front loader construction vehicle such as skid steer loader.

FIG. 3 represents an hydraulic schematic diagram of an exemplary hydraulic motor and cylinder driven implement, the implement being a concrete or asphalt grinding cold planer. The rotary grinding drum of the cold planer is driven by an hydraulic motor 64. The lateral or side shifting position of the cold planer is controlled by a double acting hydraulic cylinder 66. The tilt of the cold planer is controlled by a second double acting hydraulic cylinder 68; and the grinding depth of the cold planer is controlled by a third double acting hydraulic cylinder 70. Alternately positioning control of the cold planer may be provided by hydraulic motor driven gears. Each of the double acting hydraulic cylinders 66, 68 and 70 are bi-directionally controlled by a five port, three position hydraulic position control valve, 72, 74 and 76, respectively. The fifth port of each of the position control valves 72, 74 and 76 is a load signaling port, which upon actuation of the valve, sends a load signaling pulse of hydraulic pressure through a load signaling line 78. The position control valves 72, 74 and 76 preferably are mounted upon the cold planing implement. Upon attachment of the cold planer to a front loader construction vehicle, such as a front loader tractor or a skid steer loader, the cold planer preferably is remotely, mechanically or electrically actuatable from the cab or operator's seat of the vehicle through cables having slidable extendable and retractable cores or through electrically switched solenoids.

In operation, referring simultaneously to FIGS. 2 and 3, the high pressure line flow check coupling 80 is snapped onto the flow checked coupling 54 of the high flow pressure line 50, and the flow checked return line coupling 82 is snapped onto the high flow valve return line coupling 56. Upon so attaching said couplings, the cold planer is hydraulically attached to and is actuatable by the hydraulic power system of the skid steer loader.

Upon such attachment, approximately 34 gallons per minute of flow of hydraulic oil passes through the cold planer main pressure line 84. Pressure from the cold planer main pressure line 84 is controlled by a four port on demand priority flow control valve 86 having an input pressure port, a priority output port, a secondary output port, and a load sensing port; an end of the load signaling line 78 being fixedly attached to the load sensing port, and an end of the cold planer main pressure line 84 being fixedly attached to the input port. While the on demand priority flow control valve is in its normal position, flow passes therethrough to its secondary output port and thence into a hydraulic motor high pressure line 88. The hydraulic motor high pressure line 88 supplies up to 34 gallons per minute of hydraulic oil flow to the hydraulic motor 64, the oil returning to the reservoir 2 through a hydraulic motor return line 90.

Upon actuation of any one of the position control valves 72, 74 or 76, a pulse of hydraulic pressure passes through the load signaling line 78 causing the on demand priority flow control valve 86 to divert approximately two gallons per minute of hydraulic oil flow from the hydraulic motor pressure line 88 to the cylinder pressure line 92. The on demand priority flow control valve 86 operates to divert two gallons per minute of flow to the cylinder pressure line 92 so long as at least two gallons per minute of flow is available from the cold planer main pressure line 84. Such priority of pressure assures that control of cylinders 66, 68 and 70 will continue to be available so long as sufficient flow is available from the skid steer loader. Pressure from the cylinder pressure line 92 is selectively controlled by the position control valves 72, 74 and 76, with hydraulic oil returning to the reservoir 2 through a return line 94.

In operation, referring simultaneously to FIGS. 2 and 3, an exemplary hydraulic motor driven and cylinder positioned cold planing machine is fixedly attached to the lift arms of a skid steer loader, and couplings 56 and 54 are attached to couplings 82 and 80, respectively. Upon such attachment, the skid steer loader is driven and the lift arm valve 8 and the loader bucket valve 10 are actuated to properly position the cold planer upon an asphalt or concrete surface to be planed. Upon release of the actuation levers of the lift arm valve 8 and of the loader bucket valve 10, hydraulic pressure from the main hydraulic pump 4 passes through their power forward ports to the auxiliary hydraulic valve power forward line 28. Hydraulic pressure and flow from the auxiliary hydraulic valve pressure line 28 combines with oil from the high flow pressure line 20 to provide approximately 34 gallons per minute of flow to the double pressure and flow line 60. Upon actuation of the high flow valve 14, the approximately 34 gallons per minute of oil flow passes therethrough, and into the cold planer main pressure line 84. So long as none of the position control valves 72, 74 or 76 are actuated, the on demand priority flow control valve 86 directs all hydraulic pressure and flow from the main cold planer pressure line 84 to the hydraulic motor 64, for turning the rotary grinding drum of the cold planer. While the cold planer is operating, the position control valves 72, 74 or 76 may be selectively actuated for controlling the side position orientation of the cold planer through the action of the side shift cylinder 66; for controlling the tilt of the cold planer through actuation of the tilt control cylinder 68; or for control of grinding depth through actuation of the depth control cylinder 70.

Thus, in accordance with the above described configuration of the present invention, beneficial use is made of the on demand priority flow control valve 86 to provide an additional level of assurance that hydraulic pressure and flow will always be available for control of the positioning cylinders of the cold planer, and to achieve advantages in efficiency, economy and ease of connection by reducing the required connections to two in number.

The above disclosure is not intended as a restriction on application of the invention to cold planing implements or to any particular type of construction vehicle having a hydraulic power system. For example, the above disclosed invention is equally applicable to tree stump grinders which are attachable as an auxiliary implement to the lift arms of a front loader construction vehicle, the stump grinder being rotably driven by a hydraulic motor and positionable by hydraulic cylinders. The invention is similarly applicable for attachment to a backhoe attachment assembly to a loader/backhoe construction vehicle. Further, the invention is equally applicable where the workpiece of the auxiliary implement is both driven and positioned by hydraulic motors. Thus, it is to be understood that the present invention is not to be limited by the above exemplary description of a preferred embodiment except insofar as such limitations are included in the following claims and allowable functional equivalents thereof.

I claim:

1. An hydraulic line and valve assembly for supplying hydraulic pressure and fluid flow to an hydraulically powered auxiliary implement, the auxiliary implement being adapted for attachment to a construction vehicle having an hydraulic power system, the auxiliary implement having an hydraulic motor driven work piece, and the auxiliary implement having a plurality of hydraulic positioning means for positioning the work piece, the hydraulic line and valve assembly comprising:

(a) An on demand priority flow control valve having a pressure inlet port, a primary pressure outlet port, a secondary pressure outlet port, and a load sensing port, the pressure inlet port being adapted for attachment to an hydraulic pressure line extending from the hydraulic power system of the construction vehicle, and the secondary pressure outlet port being adapted for attachment to an hydraulic motor pressure line extending to the hydraulic motor;

(b) A primary pressure line having a first end and having a plurality of second ends, said first end being fixedly attached to the primary pressure outlet port of the on demand priority flow control valve;

(c) A plurality of position control valves, each such position control valve having a load signaling port, each such position control valve having a primary pressure line inlet port, and each such position control valve having a plurality of position control outlet ports, each such position control outlet port being adapted for attachment of a position control line for driving the hydraulic positioning means, the second ends of the primary pressure line being respectively fixedly attached to the primary pressure line inlet ports of the position control valves; and, (d) A hydraulic load signaling line having a first end and plurality of second ends, said first end being fixedly attached to the load sensing port of the on demand priority flow control valve, and said second ends being respectively fixedly attached to the load signaling ports of the position control valves, the hydraulic load signaling line, upon the introduction of hydraulic pressure into the pressure inlet port of the on demand priority flow control valve and upon the actuation of one of the position control valves, sending a pressure signal to the on demand priority flow control valve causing said valve to divert a portion of said hydraulic pressure to said valve's primary pressure outlet port, supplying hydraulic power to the hydraulic positioning means.

2. The hydraulic line and valve assembly of claim 1, wherein a plurality of the position control valves are three position valves, each having a normal flow blocked valve position and each having alternate valve positions for providing bi-directional movement of the hydraulic positioning means.

3. The hydraulic line and valve assembly of claim 2, wherein the on demand priority flow control valve is mounted upon the hydraulically powered auxiliary implement.

4. The hydraulic line of valve assembly of claim 3, wherein a plurality of the position control valves are mounted upon the hydraulically powered auxiliary implement.

5. The hydraulically line and valve assembly of claim 4, wherein a plurality of the position control valves are remotely actuatable from the construction vehicle.

6. The hydraulic line and valve assembly of claim 5, wherein the plurality of three position position control valves comprises a side shift control valve for controlling sideways positioning of the hydraulically powered auxiliary implement, a tilt control valve for controlling the tilt of the hydraulically powered auxiliary implement, and a depth control valve for controlling the vertical position of the hydraulically powered auxiliary implement.

7. The hydraulic line and valve assembly of claim 5, wherein the means of remote actuation is a plurality of cables, each having a slidable, and alternately extendable and retractable core, the cables interconnecting manual actuation means mounted upon the construction vehicle with the actuation means of the position control valves.

8. The hydraulic line and valve assembly of claim 5, wherein the means of remote actuation is a plurality of solenoid magnets, the solenoid magnets being actuated by electronic switches mounted upon the construction vehicle, and the solenoid magnets being fixedly attached to and being capable of actuating the actuation means of the position control valves.

* * * * *